US006471583B1

(12) United States Patent
Kondo

(10) Patent No.: US 6,471,583 B1
(45) Date of Patent: Oct. 29, 2002

(54) METHOD OF MACHINING RARE EARTH ALLOY AND METHOD OF FABRICATING RARE EARTH MAGNET USING THE SAME

(75) Inventor: Sadahiko Kondo, Hyogo (JP)

(73) Assignee: Sumitomo Special Metals Co., Ltd. (JP)

( * ) Notice: Subject to any disclaimer, the term of this patent is extended or adjusted under 35 U.S.C. 154(b) by 0 days.

(21) Appl. No.: 09/566,736

(22) Filed: May 9, 2000

(30) Foreign Application Priority Data

May 13, 1999 (JP) ..... 11-132179

(51) Int. Cl.[7] ..... B24B 1/00

(52) U.S. Cl. ..... 457/28; 457/53; 457/449; 457/488; 125/13.01; 125/13.06; 125/11.22; 125/20; 125/29; 125/557

(58) Field of Search ..... 125/11.22, 12, 125/13.01, 16.01, 20, 28; 451/488, 449, 450, 53, 60; 29/557; 83/651.1, 121; 252/62.55, 62.63

(56) References Cited

U.S. PATENT DOCUMENTS 4,016,855 A * 4/1977 Mimata ..... 125/11.22
4,457,851 A * 7/1984 Tabaru et al. ..... 252/62.63
4,770,723 A 9/1988 Sagawa et al.
4,792,368 A 12/1988 Sagawa et al.
5,203,122 A * 4/1993 Campbell ..... 451/53
6,071,047 A * 6/2000 Nakai ..... 409/131
6,123,606 A * 9/2000 Hill et al. ..... 451/53
6,381,830 B1 * 5/2002 Chikuba et al. ..... 29/557

FOREIGN PATENT DOCUMENTS

| | | |
|---|---|---|
| JP | 61-264106 | 11/1986 |
| JP | 05-228816 | 9/1993 |
| JP | 08-109431 | 4/1996 |
| JP | 08/109432 | 4/1996 |
| JP | 09-174441 | 7/1997 |
| JP | 10-329023 | 12/1998 |

* cited by examiner

*Primary Examiner*—George Nguyen
(74) *Attorney, Agent, or Firm*—Nixon Peabody LLP; Jeffrey L. Costellia

(57) ABSTRACT

The invention provides a method of machining a rare earth alloy at high machining preciseness and high efficiency. In a step of grinding a block of a rare earth alloy with a grinding wheel having, on a peripheral portion thereof, a grinding edge including diamond abrasive particles, a coolant with surface tension of 25 mN/m through 60 mN/m is supplied to the grinding edge with the grinding wheel rotated.

42 Claims, 5 Drawing Sheets

METHOD OF MACHINING RARE EARTH ALLOY AND METHOD OF FABRICATING RARE EARTH MAGNET USING THE SAME

BACKGROUND OF THE INVENTION

The present invention relates to a method of machining a rare earth alloy, and more particularly, it relates to a method of grinding and cutting a rare earth alloy suitably used as a material for a magnet.

A rare earth alloy is used, for example, as a material for a powerful magnet. A rare earth magnet obtained by magnetizing a rare earth alloy is suitably used, for example, as a material for a voice coil motor for use in positioning a magnetic head of a magnetic recording device.

As a method of cutting a rare earth magnet, Japanese Laid-open Patent Publication No. 9-174441 discloses use of a peripheral cutting edge (sometimes designated as "a grinding wheel" or "a grindstone") with a cutting part onto which diamond abrasive particles are adhered in a ratio of 10 through 80%.

Also, the applicant of the base Japanese application of the present application has proposed, in Japanese Laid-Open Patent Publication No. 61-264106, a method of machining a R—Fe—B rare earth alloy with a diamond grinding wheel or the like in a non-oxidizing oil for preventing oxidation of the surface of the rare earth alloy.

As a result of various examination of the method of machining a rare earth alloy, however, the present inventors have found that the conventional methods have problems described below. In particular, in order to efficiently and precisely machine a rare earth alloy having a main phase where brittle fracture is caused and a boundary layer where ductile breaking is caused, such as a rare earth alloy prepared by sintering (hereinafter referred to as the "rare earth sintered alloy"), it is necessary to efficiently release heat generated in machining, namely, to cool a part to be machined.

For example, even when the grinding wheel disclosed in Japanese Laid-Open Patent Publication No. 9-174441 is used, the temperature of the grinding edge abnormally increases unless a part to be machined is efficiently cooled, and the abnormally high temperature can cause abnormal abrasion of the grinding edge or abnormally large loss of the diamond abrasive particles. The abnormal abrasion and the abnormally large loss can disadvantageously degrade the machining preciseness as well as increase the machining cost because the life of the expensive grinding wheel is shortened. This publication does not mention anything about cooling a part to be machined.

Furthermore, in the method disclosed in Japanese Laid-Open Patent Publication No. 61-264106, although the non-oxidizing oil can suppress the oxidation, it is difficult to sufficiently cool the grinding wheel including the diamond abrasive particles.

SUMMARY OF THE INVENTION

The present invention was devised to overcome the aforementioned problems, and an object is providing a method of highly precisely and efficiently machining a rare earth alloy and a method of fabricating a rare earth magnet using the same.

The method of machining a rare earth alloy of this invention includes the steps of providing a block of the rare earth alloy; rotatably supporting a grinding wheel having, on a peripheral portion thereof, a grinding edge including diamond abrasive particles; and grinding the block of the rare earth alloy by bringing the grinding edge into contact with the block, with the grinding wheel rotated and with a coolant having surface tension of 25 mN/m through 60 mN/m supplied to the grinding edge of the grinding wheel. As a result, the above-described object is achieved.

Alternatively, the method of machining a rare earth alloy of this invention includes the steps of providing a block of the rare earth alloy; rotatably supporting a grinding wheel having, on a peripheral portion thereof, a grinding edge including diamond abrasive particles; and grinding the block of the rare earth alloy by bringing the grinding edge into contact with the block, with the grinding wheel rotated and with a coolant having a coefficient of dynamic friction against the rare earth alloy of 0.1 through 0.3 supplied to the grinding edge of the grinding wheel. As a result, the above-described object is achieved.

The coolant preferably includes water as a main component. Also, the coolant preferably includes an antifoaming agent. In addition, the coolant preferably has pH of 9 through 11. The coolant preferably further includes a rust inhibitor.

In the method of machining a rare earth alloy, the grinding edge of the grinding wheel preferably further includes a phenol resin and includes the diamond abrasive particles in a. volume ratio of 10 through 80%. Preferably, the grinding wheel has a disk-shaped base plate, the grinding edge is disposed on a peripheral portion of the base plate, and the base plate is made from a sintered hard alloy.

In the method of machining a rare earth alloy, the rare earth alloy can be a R—Fe—B rare earth sintered alloy.

The coolant is preferably jetted toward the grinding edge.

The method of machining a rare earth alloy may further include the steps of collecting sludge including grinding waste of the rare earth alloy and the coolant produced in the step of grinding the block; and separating the grinding waste of the rare earth alloy from the collected sludge by using a magnet.

When the step of grinding the block includes a step of moving the grinding wheel relatively to the block, the block can be cut into pieces by the present method of machining a rare earth alloy.

Preferably, in the step of grinding the block, a rotating speed of the grinding wheel, a cutting speed and a pressure for jetting the coolant are adjusted, whereby a force Fx along a tangent of the grinding wheel and a force Fz along a radial direction of the grinding wheel applied to the block respectively fall within predetermined ranges.

The method of machining a rare earth alloy preferably further includes the steps of monitoring the force Fx and the force Fz; and determining whether or not the force Fx and the force Fz respectively are within the predetermined ranges.

The method of fabricating a rare earth magnet of this invention includes the steps of providing a block of the rare earth alloy; rotatably supporting a grinding wheel having, on a peripheral portion thereof, a grinding edge including diamond abrasive particles; grinding the block of the rare earth alloy by bringing the grinding edge into contact with the block, with the grinding wheel rotated, with a coolant having surface tension of 25 mN/m through 60 mN/m supplied to the grinding edge of the grinding wheel, and with the grinding wheel moved relatively to the block, whereby the block is cut into pieces; and magnetizing the rare earth alloy. As a result, the above-described object is achieved.

The method of fabricating a rare earth magnet of this invention is practiced by using the aforementioned method of machining a rare earth alloy.

DETAILED DESCRIPTION OF THE INVENTION

Figure 1:
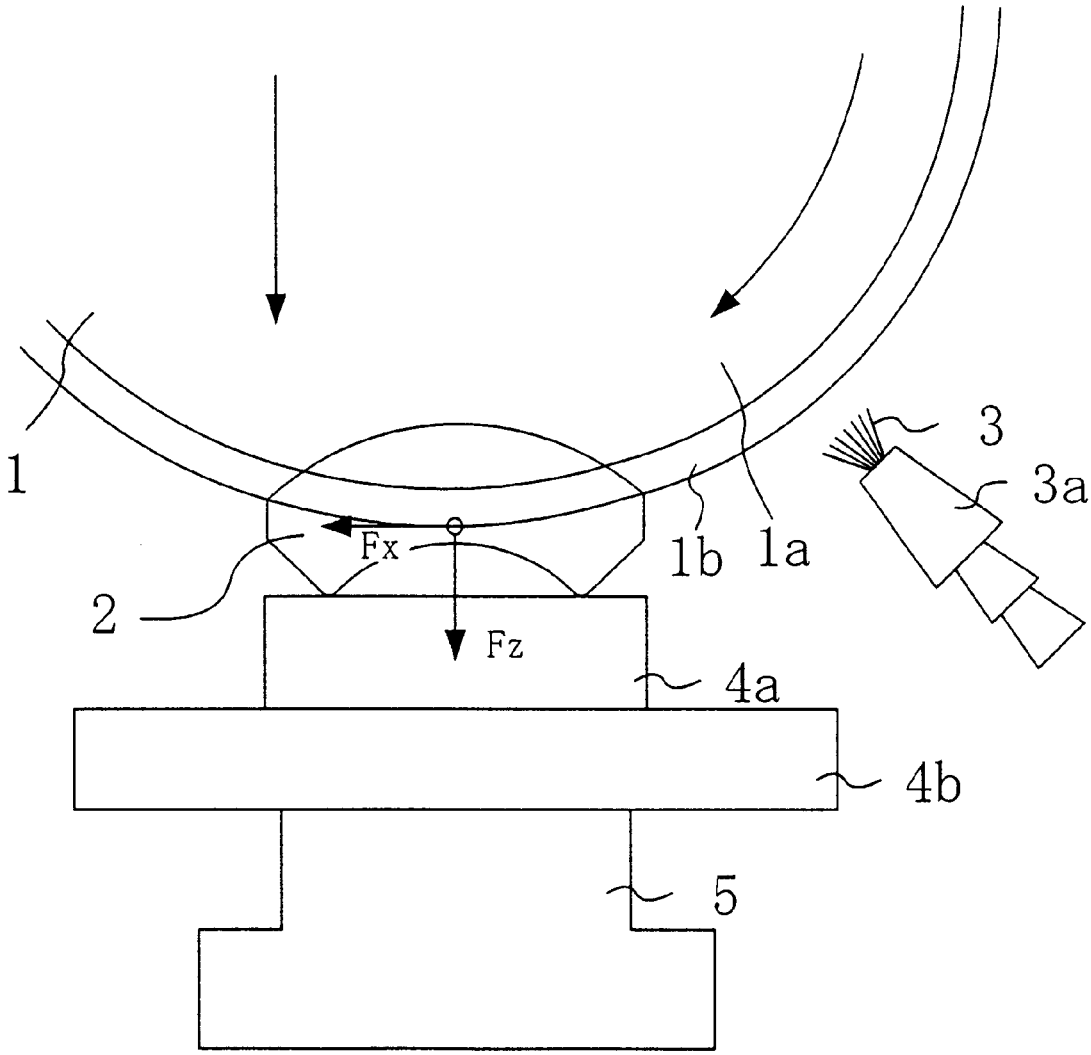
FIG. 1 is a schematic diagram for showing a cutting state of a rare earth alloy block in a machining method according to an embodiment of the invention.

Now, preferred embodiments of a method of machining a rare earth alloy and a method of fabricating a rare earth magnet will be described.

The method of machining a rare earth alloy of this invention includes the steps of providing a block of a rare earth alloy; rotatably supporting a grinding wheel having, on its peripheral portion, a grinding edge including diamond abrasive particles; and grinding the block of the rare earth alloy by bringing the grinding edge into contact with the block with the grinding wheel rotated and with a coolant (sometimes referred to as a "grinding solution") having surface tension of approximately 25 mN/m through approximately 60 mN/m (approximately 25 dyn/cm through approximately 60 dyn/cm) at 25° C. supplied to the grinding edge of the grinding wheel. The coolant can be replaced with one having a coefficient of dynamic friction against the rare earth alloy of 0.1 through 0.3 at 25° C.

In the present method of machining a rare earth alloy, the coolant, which is supplied to the grinding edge in the step of grinding the rare earth alloy with the grinding wheel having, on the peripheral portion, the grinding edge including the diamond abrasive particles, has surface tension at 25° C. of approximately 25 mN/m through approximately 60 mN/m (approximately 25 dyn/cm through approximately 60 dyn/cm). Therefore, the grinding edge can be efficiently cooled. This is probably because the coolant having surface tension within the aforementioned range is so superior to water in permeability (wettability or conformability) in the grinding edge including the diamond abrasive particles that the coolant can efficiently permeate a grind part (i.e., apart of the rare earth alloy brought into contact with the grinding edge to be ground). The coolant suitably used in the grinding can be selected on the basis of the coefficient of dynamic friction against the rare earth alloy. A coolant having a coefficient of dynamic friction at 25° C. of approximately 0.1 through approximately 0.3 can exhibit the equivalent function and effect to that of the coolant having the surface tension within the above-described range. While the surface tension may be regarded as an index of the permeability of the coolant in the grinding edge, the coefficient of dynamic friction may be regarded as an index of the lubricating property provided to the grinding edge by the coolant. It is known that there is a qualitative correlation between surface tension and a coefficient of dynamic friction.

The surface tension of the coolant is measured with a well known du Nouy surface meter. Also, the coefficient of dynamic friction of the coolant against the rare earth alloy is measured with a Masuda type "four-ball tester" widely used as a basic tester in Japan. With respect to both the surface tension and the coefficient of dynamic friction, the values obtained at 25° C. are herein adopted for characterizing the coolant.

The coefficient of dynamic friction mentioned in the embodiment below is obtained with the four-ball tester by using iron balls. A R—Fe—B rare earth alloy (for example, an alloy including a $Nd_2Fe_{14}B$ intermetallic compound as the main phase) exemplified in the embodiment includes iron at the largest content, and hence, the coefficient of dynamic friction of the coolant obtained by using the iron balls can be sufficiently approximate to and regarded as the coefficient of dynamic friction against the rare earth alloy. The composition and the method of preparing the rare earth alloy are described in, for example, U.S. Pat. Nos. 4,770,723 and 4,792,368, which are incorporated herein by reference.

Although the coolant used in the present machining method is herein specified by using the surface tension or the coefficient of dynamic friction at 25° C., the temperature of the coolant in actual use is not limited to 25° C. In order to achieve the effect of the invention, however, the coolant is preferably controlled in its temperature within the range between 20° C. and 30° C. As is well known, the surface tension and the coefficient of dynamic friction of the coolant depend upon the temperature. Therefore, state where the temperature of the coolant in actual use is too far from the aforementioned range is similar to state where the surface tension and the coefficient of dynamic friction of the coolant are out of the aforementioned ranges, and hence, the cooling efficiency is degraded in such a state.

Since the abnormal temperature increase of the grinding edge can be suppressed by using the coolant, the abnormal abrasion of the grinding edge as well as the abnormally large loss of the diamond abrasive particles can be suppressed or avoided. As a result, the degradation in the machining preciseness can be prevented, and the machining cost can be reduced because the grinding wheel can be used for a longer period of time than in the conventional technique.

The coolant preferably includes water as a main component. This is because water has comparatively large specific heat and hence has high cooling efficiency. In addition, when the coolant includes water, the surface tension and the coefficient of dynamic friction can be easily adjusted within the aforementioned ranges by controlling the type and the amount of a surfactant to be added. Also, the surface tension and the coefficient of dynamic friction within the above-described ranges can be obtained by adding, instead of the surfactant, a synthetic lubricant generally called as "synthetic" to water. Furthermore, when the coolant includes water as a main component, the viscosity of the coolant is comparatively low, and hence, waste of the rare earth alloy can be easily separated with a magnet from sludge produced through the grinding. Thus, the coolant can be recycled. Moreover, when discarded, the coolant can be prevented from harmfully affecting the natural environment. Since the rare earth alloy is exposed to the coolant for a comparatively short period of time, the characteristic of the rare earth alloy cannot be degraded through oxidation caused during the exposure.

When the grinding is carried out with the grinding wheel rotated at a high speed, the coolant can foam up, which can degrade the cooling efficiency. Addition of an antifoaming agent to the coolant can suppress this degradation of the cooling efficiency. Furthermore, when the coolant has pH in the range between 9 and 11, corrosion of the rare earth alloy can be suppressed. Moreover, addition of a rust inhibitor to the coolant can suppress oxidation of the rare earth alloy. These additives can be appropriately adjusted in consideration of the type of rare earth alloy and machining conditions.

The grinding wheel has the grinding edge including diamond abrasive particles. Preferably, a resin is used as a binder for adhering the diamond abrasive particles onto the peripheral portion of a disk-shaped base plate of the grinding wheel. In other words, the grinding wheel preferably has a grinding edge including a resin and the diamond abrasive particles. More preferably, the grinding wheel has a grinding edge including a phenol resin as the binder and the diamond abrasive particles in a volume ratio of 10 through 80% and preferably 10 through 50%. The phenol resin is good at adhesion strength onto the peripheral portion of the disk-shaped base plate described below as well as good at wettability (permeability) against the coolant as described below. Also, when the volume ratio of the diamond abrasive particles is within the aforementioned range, the diamond abrasive particles can be suppressed from being abnormally largely lost but are appropriately lost (namely, particles with lowered grinding power alone are lost), resulting in stabilizing the grinding. When the grinding wheel has the grinding edge including a phenol resin and an appropriate amount of diamond abrasive particles in this manner, not only high machining preciseness can be attained but also the cooling effect of the coolant can be remarkably exhibited. As a result, the rare earth alloy can be stably ground for a long period of time.

The base plate of the grinding wheel is preferably made from a sintered hard alloy. For example, a tungsten carbide type sintered hard alloy has a high elastic modulus and is minimally deformed by a force applied in machining, and therefore, high machining preciseness can be attained when this alloy is used for the base plate. Also, since the sintered hard alloy has high heat conductivity, the frictional heat generated on the grinding edge can be efficiently released. Thus, the grinding wheel preferably has a base plate of a sintered hard alloy from the viewpoint of the machining preciseness and the cooling efficiency.

The aforementioned grinding wheel can be available from a general manufacturer of grinding wheels (such as Asahi Diamond Industrial Co., Ltd.) by designating the above-described specification.

Alternatively, the base plate of the grinding wheel can be a diamond sintered substance including a hard metal as a binder (described in, for example, Japanese Laid-Open Patent Publication No.8-109431) or a cubic boron nitride sintered substance including a hard metal as a binder (described in, for example, Japanese Laid-Open Patent Publication No. 8-109432). In particular, the diamond sintered substance (available from Lead Co., Ltd.) is preferably used as the base plate of the grinding wheel owing to its Young's modulus as high as approximately 550 GPa (approximately 55,000 kgf/mm$^2$). Moreover, since this diamond sintered substance bears a diamond powder on its surface, it can be used also as the grinding edge without independently providing the grinding edge. Also in such a case, the cooling effect of the coolant can be sufficiently exhibited.

The grinding wheel is generally rotated at a high speed, which causes a stream of air designated as an "accompanying air stream" around the periphery of the grinding wheel. The coolant can be stably supplied to the grinding edge without being hindered by the accompanying air stream by jetting the coolant toward the grinding edge. In this manner, the rapidly rotating grinding wheel can be efficiently cooled. Also, when the coolant is jetted, the coolant can be supplied with a more compact or simpler structure than in the case where the grinding wheel is immersed in a bath of the coolant.

When the sludge, which is produced through the grinding and includes the grinding waste of the rare earth alloy and the coolant, is collected so as to separate the grinding waste of the rare earth alloy by using a magnet from the collected sludge, the coolant can be recycled (for example, cyclically used). The coolant is suitably recycled when it includes water as described above. Also, when the grinding waste of the rare earth alloy is thus separated, the resultant grinding solution can be simply discarded without damaging the environment.

It goes without saying that the rare earth alloy block can be cut into work pieces by grinding the block with the grinding wheel moved relatively to the block. In the machining method of this invention, the rare earth alloy block can be precisely and efficiently cut. Therefore, a small piece of the rare earth alloy for use in, for example, a voice coil motor used in positioning a magnetic head, can be precisely and efficiently fabricated.

Furthermore, the rotation speed of the grinding wheel, the cutting speed and the pressure for jetting the coolant a read justed in the grinding so that a force Fx applied to the block along a tangent of the grinding wheel and a force Fz applied to the block along a radial direction of the grinding wheel can fall within predetermined ranges. Thus, the machining preciseness and/or the machining efficiency can be improved. Furthermore, when the grinding is carried out with the forces Fx and Fz monitored so as to check whether or not the forces Fx and Fz are within the predetermined ranges, the quality of machined products can be controlled and the exchange timing of the grinding wheel can be appropriately determined. As a result, the machining efficiency can be further improved.

In the grinding, the force Fx applied to the rare earth alloy block along the tangent of the grinding wheel (typically in the horizontal direction) and the force Fz applied to the block in the radial direction of the grinding wheel (typically in the vertical direction) can be measured with a known dynamometer using a quartz sensor (available from, for example, Kistler Japan Co., Ltd.).

As described above, the present machining method is preferably applied to machining of a rare earth sintered alloy difficult to machine, in particular, a R—Fe—B rare earth sintered alloy. A rare earth magnet can be obtained by magnetizing a rare earth alloy machined by the present machining method. The magnetization can be conducted before or after the grinding. In particular, a rare earth sintered magnet fabricated from a R—Fe—B rare earth sintered alloy is suitably used as a material for a voice coil motor used in positioning a magnetic head. Preferably, the present machining method is used for machining a R—Fe—B rare earth sintered magnet (alloy) disclosed in U.S. Pat. Nos. 4,770,723 and 4,792,368 assigned to the applicant of the base Japanese application of the present application. More preferably, the present method is applied to machining and fabrication of a rare earth sintered magnet (alloy) that includes neodymium (Nd), iron (Fe) and boron (B) as main components and has a hard main phase of a $Nd_2Fe_{14}B$ intermetallic compound with a tetragonal structure (an iron-rich phase) and a Nd-rich ductile grain boundary phase (hereinafter referred to as the "neodymium magnet (alloy)"). A specific example of the neodymium magnet is NEOMAX (trade name) manufactured by Sumitomo Special Metals Co., Ltd.

EMBODIMENT

An embodiment of the method of machining (grinding and cutting) a rare earth alloy of this invention will now be described.

FIG. 1 is a schematic diagram for showing the cutting state of a rare earth alloy block (sometimes referred to as the work) in this embodiment.

FIG. 1 shows the state where the rare earth alloy block (work) 2 is being cut by the grinding with a grinding wheel 1.

The block 2 used in this embodiment is a neodymium alloy with a height (along the lengthwise direction of the drawing) of approximately 20 mm, a length (along the width wise direction of the drawing) of approximately 40 mm and a width (along the perpendicular direction to the surface of the drawing) of approximately 60 mm. The block 2 has an arched surface, from which the block 2 is ground to be cut.

The grinding wheel 1 includes a disk-shaped base plate 1*a* and a grinding edge 1*b* provided on the peripheral portion of the base plate 1*a*. In this embodiment, the base plate 1*a* is made from a sintered hard alloy such as tungsten carbide. More preferably, it is made from a sintered hard alloy having a Young's modulus of approximately 450 GPa through approximately 700 GPa (approximately 45,000 kgf/mm$^2$ through approximately 70,000 kgf/mm$^2$). When the Young's modulus is lower than approximately 450 GPa (approximately 45,000 kg/mm$^2$), the base plate can be warped or waved while cutting, and when it exceeds approximately 700 GPa (70,000 kgf/mm$^2$), the base plate is so hard and brittle that it can be easily damaged. A tungsten carbide type sintered hard alloy is advantageous also because frictional heat generated on the grinding edge 1*b* provided on the base plate la can be efficiently released due to its heat conductivity as high as approximately 59 W/m·° C. (approximately 0.14 cal/cm·sec.).

The grinding edge 1*b* is formed by adhering, with a resin, diamond abrasive particles (powder) with a particle size of 0.1 through 0.3 mm onto the peripheral portion of the base plate 1*a* in, for example, a volume ratio of 10 through 80%. The volume ratio of the diamond abrasive particles is more preferably 10 through 50%. As the abrasive particles, a natural or synthetic industrial diamond abrasive powder is used. The abrasive particles can include cubic boron nitride (cBN).

The grinding edge 1*b* preferably includes a phenol resin 1 as the resin for adhering the abrasive particles. In this embodiment, the grinding wheel 1 has the grinding edge 1*b* including diamond abrasive particles in a volume ratio of 10 through 50% and a phenol resin. When the phenol resin is thus included, the grinding can be carried out at high cutting efficiency because the phenol resin is appropriately abraded by heat generated during the grinding.

In this embodiment, the grinding wheel 1 has a radius of approximately 150 mm, a thickness of the base plate 1*a* of 0.5 mm, a thickness of the grinding edge 1*b* of 0.6 mm, and a width (a length in the radial direction) of the grinding edge 1*b* of approximately 3 mm. Although merely one grinding wheel 1 is shown in FIG. 1, for example, six grinding wheels 1 can be disposed in parallel to one another (in the perpendicular direction to the surface of the drawing) with a pitch of 2 mm, so that the block 2 can be simultaneously cut into seven pieces.

The grinding wheel 1 is rotated at a peripheral speed of 1000 through 3000 m/min., so that the block 2 can be cut in a direction shown with an arrow (namely, in a z-direction typically corresponding to the vertical direction) at a cutting speed of 3 through 10 mm/min. When the peripheral speed is lower than 1000 m/min., the grinding edge 1*b* is abnormally abraded and the abrasive particles are abnormally largely lost. When the peripheral speed exceeds 3000 m/min., the accompanying air stream is so large that a coolant is difficult to supply and the entire system is vibrated. Also, when the cutting speed is lower than 3 mm/min., the production efficiency is poor, and when it exceeds 10 mm/min., the grinding wheel is abnormally abraded.

The block 2 is cut with the grinding wheel 1 with a coolant 3 supplied. The coolant 3 is supplied to the grinding edge 1*b* by jetting it from a nozzle 3*a*. Since the coolant is thus jetted toward the grinding edge 1*b*, it can be supplied to the grinding edge 1*b* without fail, which can prevent the abnormal temperature increase and the abnormal abrasion at the grinding edge 1*b*.

The coolant 3 is jetted from the nozzle 3*a* at a pressure of approximately 20 kPa through approximately 150 kPa (2 kg/cm$^2$ through 15 kg/cm$^2$) and more preferably approximately 30 kPa through approximately 70 kPa (approximately 3 kg/cm$^2$ through 7 kg/cm$^2$). When the pressure is lower than approximately 20 kPa (approximately 2 kg/cm$^2$), the coolant 3 is blown off by the air stream caused in the periphery of the grinding wheel 1 due to the rotation of the grinding wheel 1, so that the coolant cannot be sufficiently supplied to the grinding edge 1*b*. This can abnormally increase the temperature of the grinding edge 1*b*. When the pressure exceeds approximately 50 kPa (approximately 15 kg/cm$^2$), the grinding wheel 1 can be unnecessarily vibrated by pulsation of a pump used for supplying the coolant 3 or the like. As a result, the preciseness in machining the block 2 can be degraded. When the pressure is approximately 30 kPa through approximately 70 kPa (approximately 3 kg/cm$^2$ through 7 kg/cm$^2$), the life of the grinding wheel 1 can be elongated and the preciseness in machining the block 2 can be improved. Furthermore, the nozzle 3*a* jets the coolant 3 preferably in a direction perpendicular to the grind edge 1*b* (i.e., radial direction of the grinding wheel).

In this embodiment, the coolant 3 is an aqueous lubricant including water as a main component, and a surfactant or synthetic type lubricant, a rust inhibitor, a non-ferrous metal anticorrosive, an antiseptic and an antifoaming agent as other components. When the coolant 3 thus includes water as a main component, the cooling effect can be enhanced, which can suppress the abnormal temperature increase on the grind part. Also, since the coolant includes a surfactant or synthetic type lubricant, the permeating effect can be enhanced, and the surface tension and the coefficient of dynamic friction of the coolant can be easily adjusted.

Preferably, the coolant has surface tension of approximately 25 mN/m through approximately 60 mN/m (approximately 25 dyn/cm through approximately 60 dyn/cm). The coefficient of dynamic friction between the coolant and the block 2 is preferably 0.1 through 0.3.

The surfactant added to the grinding solution including water as a main component can be an anionic surfactant or a nonionic surfactant. Examples of the anionic surfactant are a fatty acid derivative such as fatty acid soap and naphthenic acid soap; a sulfate ester surfactant such as long-chain alcohol sulfate ester and sulfated oil of animal or vegetable oil; and a sulfonic acid surfactant such as petroleum sulfonate. Examples of the nonionic surfactant are a polyoxyethylene surfactant such as polyoxyethylene alkylphenyl ether and polyoxyethylene monofatty acid ester; a polyhydric alcohol surfactant such as sorbitan monofatty acid ester; and an alkylol amide surfactant such as fatty acid diethanol amide. Specifically, the surface tension and the coefficient of dynamic friction can be adjusted within the preferred ranges by adding approximately 2 wt % of a chemical solution type surfactant, JP-0497N (manufactured by Castrol Limited).

The synthetic type lubricant can be any of a synthetic solution type lubricant, a synthetic emulsion type lubricant and a synthetic soluble type lubricant, among which the synthetic solution type lubricant is preferred. Specific examples of the synthetic solution type lubricant are Syntilo 9954 (manufactured by Castrol Limited) and #870 (manufactured by Yushiro Chemical Industry Co., Ltd.). When any of these lubricants is added to water in a concentration of approximately 2 wt %, the surface tension and the coefficient of dynamic friction can be adjusted within the preferred ranges.

Furthermore, when the coolant includes a rust inhibitor, corrosion of the rare earth alloy can be prevented. In this embodiment, pH of the coolant is preferably set to 9 through 11. The rust inhibitor can be organic or inorganic. Examples of the organic rust inhibitor are carboxylate such as oleate and benzoate, and amine such as triethanol amine, and examples of the inorganic rust inhibitor are phosphate, borate, molybdate, tungstate and carbonate.

Also, an example of the non-ferrous metal anticorrosive is a nitrogen compound such as benzotriazole, and an example of the antiseptic is a formaldehyde donor such as hexahydrotriazine.

Furthermore, silicone emulsion can be used as the antifoaming agent. When the coolant includes an antifoaming agent, the coolant 3 can be prevented from foaming up so as to attain high permeability. As a result, the cooling effect can be enhanced, and the temperature increase at the grinding edge 1*b* can be avoided. Thus, the abnormal temperature increase and the abnormal abrasion of the grinding wheel 1 of the grinding edge 1*b* can be suppressed.

In the state as shown in FIG. 1, a grind resistance (cut resistance) Fx in the circumferential direction of the grinding wheel 1 and a grind resistance (cut resistance) Fz in the cutting direction are applied to the grind part (contact part) between the grinding wheel 1 and the block 2. The cut resistances Fx and Fz are measured with a quartz system four-component dynamometer 5 available from Kistler Japan Co., Ltd. On the dynamometer 5, tables (such as a steel plate) 4*a* and 4*b* each in an appropriate size are placed, on which the block 2 is disposed. In this manner, the forces (the cut resistances Fx and Fz) applied to the block 2 are transferred through the tables 4*a* and 4*b* so as to be measured with the dynamometer 5.

Various coolants with different surface tension and coefficients of dynamic friction are used to measure the cut resistances Fx and Fz for evaluation. The surface tension and the coefficients of dynamic friction of the coolants used in the evaluation are listed in Table 1 below. The coolants A and B are synthetic type coolants, the coolants C and D are chemical solution type coolants, and the coolant E is city water. Although the coefficient of dynamic friction of the coolant C is comparatively small relatively to its surface tension, there substantially is a correlation between the surface tension and the coefficient of dynamic friction.

TABLE 1

| Coolant | A | B | C | D | E |
|---|---|---|---|---|---|
| Surface tension (mN/m) | 29 | 32 | 34 | 54 | 72 |
| Coefficient of dynamic friction | 0.17 | 0.17 | 0.12 | 0.21 | 0.45 |

Figure 2:
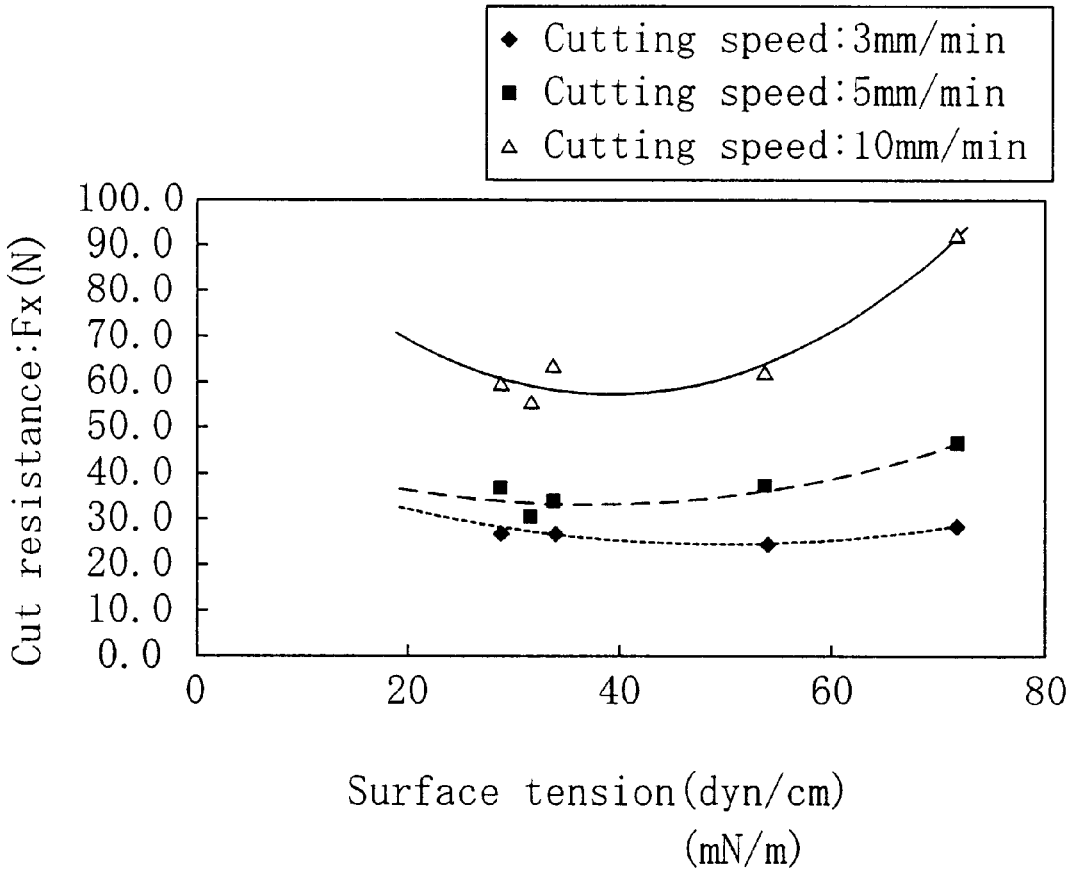
FIG. 2 is a characteristic diagram for showing change, against surface tension, of a cut resistance Fx applied in the circumferential direction of a grinding wheel 1 of FIG. 1.
Figure 3:
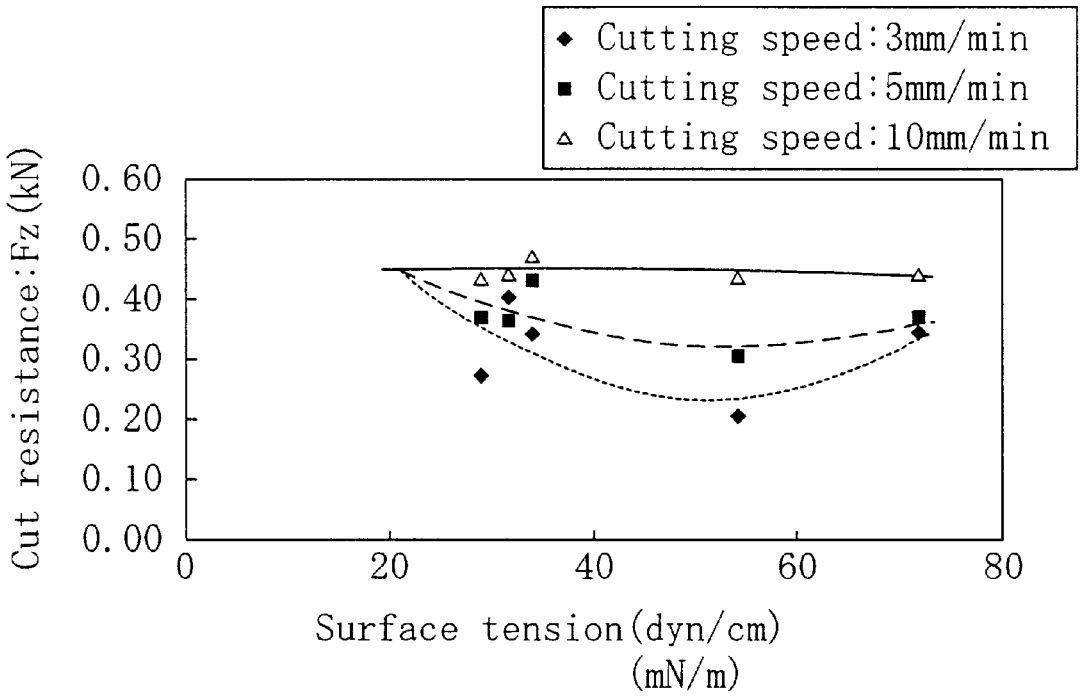
FIG. 3 is a characteristic diagram for showing change, against surface tension, of a cut resistance Fz applied in a cutting direction of the grinding wheel 1 of FIG. 1.

At this point, with the peripheral speed of the grinding wheel 1 set to 3000 m/min., change of the cut resistances Fx and Fz in accordance with the surface tension of the coolant 3 is shown in FIGS. 2 and 3, respectively. The cut resistances are measured at a cutting speed of the grinding wheel 1 of 3 mm/min., 5 mm/min., and 10 mm/min.

When the surface tension is smaller, the coolant 3 more easily permeates the grinding edge 1*b* and the block 2, and when the surface tension is larger, the coolant 3 less permeates the grinding edge 1*b* and the block 2. Accordingly, when the surface tension of the coolant is small, a large amount of the coolant is supplied to the contact part between the grinding wheel 1 and the block 2, and when the surface tension is large, a smaller amount of the coolant is supplied to the contact part between the grinding wheel 1 and the block 2.

First, with respect to the characteristic attained at a cutting speed of 10 mm/min. shown in FIG. 2, the cut resistance Fx is minimum when the surface tension is approximately 40 mN/m (approximately 40 dyn/cm), and the cut resistance Fx increases in both cases where the surface tension is smaller than and it is larger than approximately 40 mN/m. When the surface tension is larger than approximately 40 mN/m, the grinding is carried out with the coolant insufficiently supplied between the grinding edge 1*b* and the block 2, resulting in increasing the resistance. This tendency increases as the cutting speed is higher. On the other hand, when the surface tension is smaller than approximately 40 mN/m, although the coolant is sufficiently supplied, the cut resistance Fx still increases. This is because the coolant is so excessively supplied that the grinding edge 1*b* slips on the block 2, resulting in difficulty in the grinding. This is probably because the grinding wheel 1 is warped so as to cause friction between the side surface of the grinding wheel 1 and the side face of a ground groove formed in the block 2.

Next, with respect to the characteristic attained at a cutting speed of 5 mm/min. shown in FIG. 2, the cut resistance Fx is small when the surface tension of the coolant is approximately 30 mN/m through approximately 40 mN/m (approximately 30 dyn/cm through approximately 40 dyn/cm). Furthermore, with respect to the characteristic attained at a cutting speed of 3 mm/min. shown in FIG. 2, the cut resistance Fx is small when the surface tension is approximately 50 mN/m through approximately 60 mN/m (approximately 50 dyn/cm through approximately 60 dyn/cm).

Accordingly, although the range for minimizing the cut resistance Fx varies depending upon the cutting speed, when the surface tension is smaller than approximately 25 mN/m (approximately 25 dyn/cm), the coefficient of dynamic friction substantially correlative to the surface tension is smaller than 0.1. As a result, the grinding cannot be effectively carried out because the abrasive particles slip on the rare earth alloy block. Also, when the surface tension exceeds approximately 60 mN/m (approximately 60 dyn/cm), insufficient supply of the coolant leads to the tendency of increase of the cut resistance. In consideration of these facts, the surface tension of the coolant is preferably in the range between approximately 25 mN/m and approximately 60 mN/m (25 dyn/cm and 60 dyn/cm).

Next, with respect to the characteristic attained at a cutting speed of 10 mm/min. shown in FIG. 3, the cut resistance is substantially constant regardless of change of the surface tension of the coolant. In other words, when the cutting speed is 10 mm/min., the coolant hardly affects the cut resistance Fz applied along the cutting direction. Then, with respect to the characteristics attained at cutting speeds of 3 mm/min. and 5 mm/min., the cut resistance Fz is substantially equivalent to that attained at a cutting speed of 10 mm/min. when the surface tension is smaller than approximately 25 mN/m (25 dyn/cm). Therefore, when the surface tension is smaller than approximately 25 mN/m (25 dyn/cm), the coolant hardly affects the cut resistance Fz also at these cutting speeds. On the other hand, the cut resistance Fz is small when the surface tension is approximately 40 mN/m through approximately 60 mN/m (40 dyn/cm through 60 dyn/ccm).

Accordingly, when the cutting speed is lower than 10 mm/min., the coolant affects the cut resistance Fz applied along the cutting direction, but also in view of the performance in the cutting direction, the surface tension is preferably within the range between approximately 25 mN/m and approximately 60 mN/m (25 dyn/cm and 60 dyn/cm).

Figure 4:
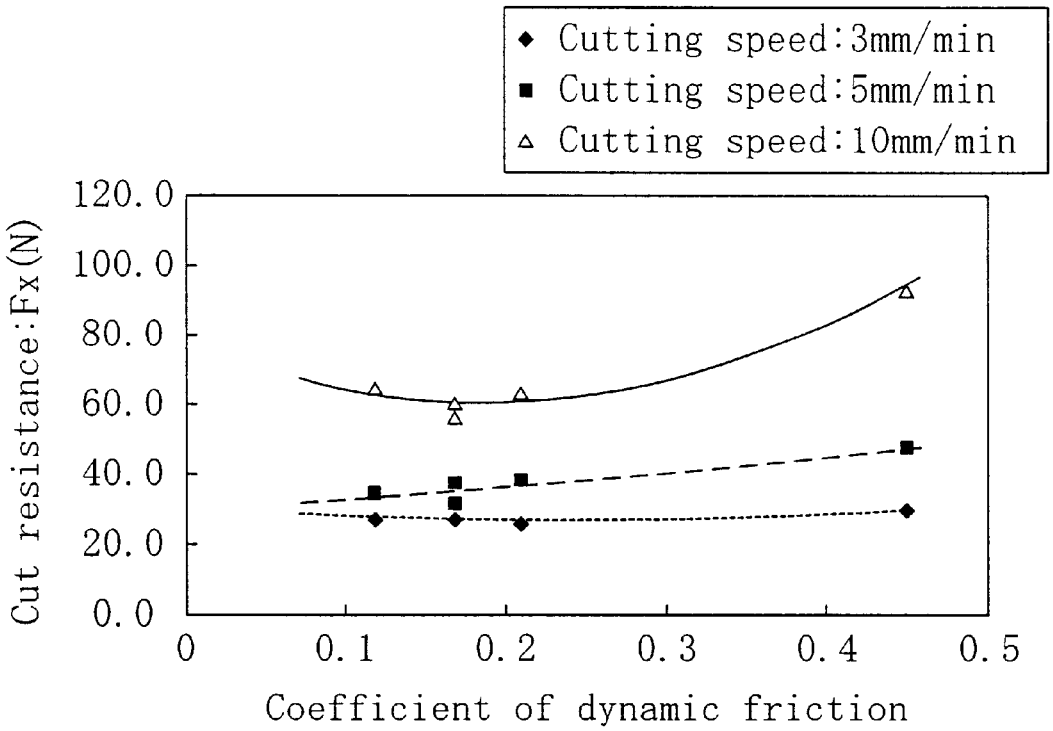
FIG. 4 is a characteristic diagram for showing change, against a coefficient of dynamic friction, of the cut resistance Fx applied in the circumferential direction of the grinding wheel 1 of FIG. 1.
Figure 5:
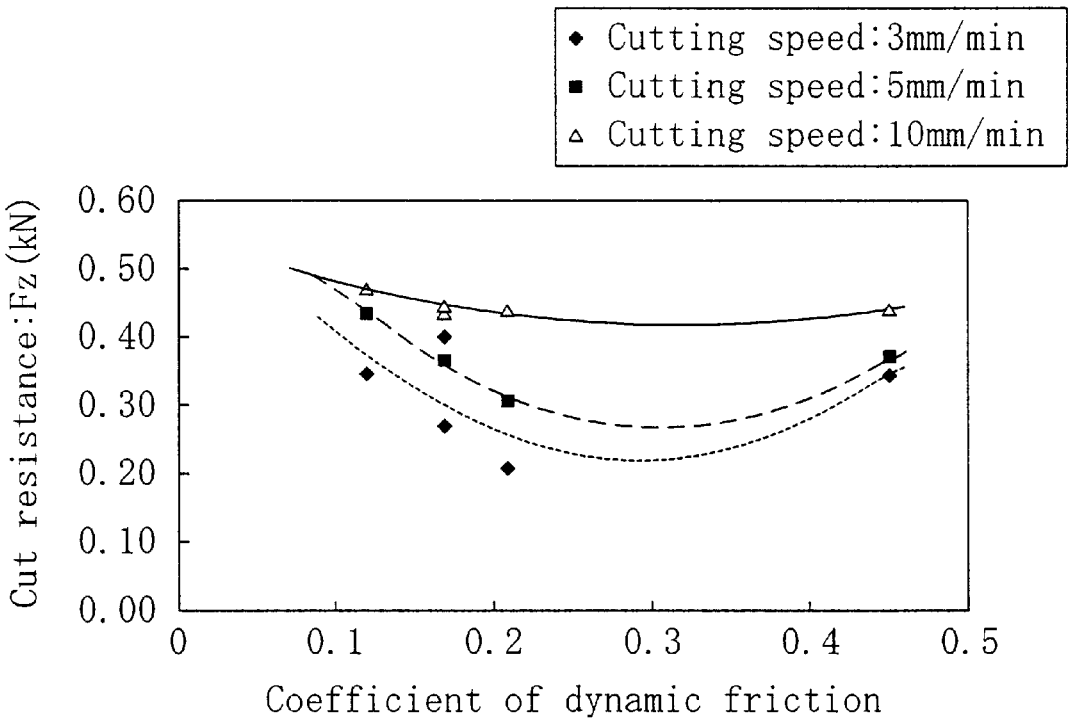
FIG. 5 is a characteristic diagram for showing change, against a coefficient of dynamic friction, of the cut resistance Fz applied in the cutting direction of the grinding wheel 1 of FIG. 1.

Furthermore, with the peripheral speed of the grinding wheel 1 set to 3000 m/min., change of cut resistances Fx and Fz in accordance with the coefficient of dynamic friction varied by changing the surface tension of the coolant 3 is shown in FIGS. 4 and 5, respectively. Also in this case, the cut resistances are measured at a cutting speed of the grinding wheel 1 of 3 mm/min. 5 mm/min. and 10 mm/min.

When the surface tension of the coolant is small, the coolant permeates the grinding edge 1*b* and the block 2 in a large amount, and hence, the coefficient of dynamic friction is small. In contrast, when the surface tension of the coolant is large, the coolant less permeates the grinding edge 1*b* and the block 2, and hence, the coefficient of dynamic friction is large.

First, with respect to the characteristic attained at a cutting speed of 10 mm/min. shown in FIG. 4, the cut resistance Fx is minimum when the coefficient of dynamic friction is approximately 0.15 through 0.2, and the cut resistance Fx increases in both cases where the coefficient of dynamic friction is smaller than 0.15 and it is larger than 0.2.

Next, with respect to the characteristics shown in FIG. 5, the cut resistance Fz is small at any of the cutting speeds when the coefficient of dynamic friction is approximately 0.3. When the coefficient of dynamic friction is smaller than 0.3, the coolant is excessively supplied so that the grinding wheel tends to slip. In particular, when the coefficient of dynamic friction is approximately 0.1, the cut resistances Fz approximate to one another regardless of the cutting speed. In other words, when the coefficient of dynamic friction is smaller than 0.1, the grinding wheel 1 hardly grinds the block but merely slips on it. On the other hand, when the coefficient of dynamic friction exceeds 0.3, the cut resistance Fz is not largely varied in FIG. 5, but large loss of the abrasive particles and the abnormal abrasion are observed when the coefficient of dynamic friction is larger than 0.3. Accordingly, the coefficient of dynamic friction is preferably within the range between 0.1 and 0.3.

The thickness of a work piece of the rare earth alloy cut from the block 2 by the aforementioned machining method is measured with a micrometer for evaluating the machining preciseness. When the surface tension of the used coolant is approximately 25 mN/m through approximately 60 mN/m (approximately 25 dyn/cm through approximately 60 dyn/cm) or when the coefficient of dynamic friction of the coolant is approximately 0.1 through approximately 0.3, sufficient machining preciseness (such as preciseness of ±75 μm) can be achieved at a cutting speed of 3 mm/min., 5 mm/min. and 10 mm/min. Furthermore, the abnormal abrasion due to the abnormal temperature increase of the grinding edge 1*b* and the abnormally large loss of the diamond abrasive particles can be suppressed, so that the grinding wheel 1 can be used for a longer period of time than the case where, for example, water (with surface tension of approximately 70 dyn/cm) is used. The machining preciseness is particularly high and the grinding wheel 1 can be used for a particularly long period of time when the surface tension of the coolant is approximately 25 mN/m through approximately 40 mN/m (approximately 25 dyn/cm through approximately 40 dyn/cm).

After flattening the surface of the obtained work piece of the rare earth alloy by mechanical polishing, the piece is coated with a protection coat for preventing oxidation and is magnetized by a general method, thereby obtaining a rare earth sintered magnet. This rare earth sintered magnet is suitably used as a material for a voice coil motor used for positioning a magnetic head. It goes without saying that a rare earth alloy can be magnetized before machining it by the present machining method.

In this manner, the effect to cool the grinding edge of the grinding wheel can be improved by adjusting the surface tension of the coolant (the index of the permeability) and the coefficient of dynamic friction (the index of the lubricating property) within the aforementioned ranges. The coolant described above has surface tension within the range between approximately 25 mN/m and approximately 60 mN/m and a coefficient of dynamic friction within the range between approximately 0.1 and approximately 0.3. Since there substantially is a correlation between the surface tension and the coefficient of dynamic friction, the coolant to be used can be selected on the basis of any of these values. However, the property of the coolant (such as ease of foaming) can fluctuate the correlation between the surface tension and the coefficient of dynamic friction, and hence, both the surface tension and the coefficient of dynamic friction are preferably within the aforementioned ranges.

In this manner, according to the present machining method, a rare earth alloy can be cut at high machining preciseness, and therefore, the material loss of the expensive rare earth alloy can be reduced. Accordingly, the machining cost of the rare earth alloy can be reduced, so that products, such as a voice coil motor for a magnetic head, can be fabricated at lower cost. Also, the life of a comparatively expensive grinding wheel can be elongated, resulting in further reducing the machining cost.

What is claimed is:

1. A method of machining a rare earth alloy comprising the steps of:

providing a block of the rare earth alloy;

rotatably supporting a grinding wheel having, on a peripheral portion thereof, a grinding edge including diamond brasive particles; and grinding the block of the rare earth alloy by bringing the grinding edge into contact with the block, with the grinding wheel rotated and with a coolant having surface tension of 25 mN/m through 60 mN/m supplied to the grinding edge of the grinding wheel.

2. The method of machining a rare earth alloy of claim 1, wherein the coolant includes water as a main component.

3. The method of machining a rare earth alloy of claim 1, wherein the coolant includes an antifoaming agent.

4. The method of machining a rare earth alloy of claim 1, wherein the coolant has pH of 9 through 11.

5. The method of machining a rare earth alloy of claim 1, wherein the coolant includes a rust inhibitor.

6. The method of machining a rare earth alloy of claim 1, wherein the grinding edge of the grinding wheel further includes a phenol resin and includes the diamond abrasive particles in a volume ratio of 10 through 80%.

7. The method of machining a rare earth alloy of claim 1, wherein the grinding wheel has a disk-shaped base plate, the grinding edge is disposed on a peripheral portion of the base plate, and the base plate is made from a sintered hard alloy.

8. The method of machining a rare earth alloy of claim 1, wherein the rare earth alloy is a R—Fe—B rare earth sintered alloy.

9. The method of machining a rare earth alloy of claim 1, wherein the coolant is jetted toward the grinding edge.

10. The method of machining a rare earth alloy of claim 1, further comprising the steps of:

collecting sludge including grinding waste of the rare earth alloy and the coolant produced in the step of grinding the block; and separating the grinding waste of the rare earth alloy from the collected sludge by using a magnet.

11. The method of machining a rare earth alloy of claim 1, wherein the step of grinding the block includes a step of moving the grinding wheel relatively to the block, whereby the block is cut into pieces.

12. The method of machining a rare earth alloy of claim 1, wherein, in the step of grinding the block, a rotating speed of the grinding wheel, a cutting speed and a pressure for jetting the coolant are adjusted, whereby a force Fx along a tangent of the grinding wheel and a force Fz along a radial direction of the grinding wheel applied to the block respectively fall within predetermined ranges.

13. The method of machining a rare earth alloy of claim 12, further comprising the steps of:

monitoring the force Fx and the force Fz; and determining whether or not the force Fx and the force Fz respectively are within the predetermined ranges.

14. A method of machining a rare earth alloy comprising the steps of:

providing a block of the rare earth alloy;

rotatably supporting a grinding wheel having, on a peripheral portion thereof, a grinding edge including diamond abrasive particles; and grinding the block of the rare earth alloy by bringing the grinding edge into contact with the block, with the grinding wheel rotated and with a coolant having a coefficient of dynamic friction against the rare earth alloy of 0.1 through 0.3 supplied to the grinding edge of the grinding wheel.

15. The method of machining a rare earth alloy of claim 14, wherein the coolant includes water as a main component.

16. The method of machining a rare earth alloy of claim 14, wherein the coolant includes an antifoaming agent.

17. The method of machining a rare earth alloy of claim 14, wherein the coolant has pH of 9 through 11.

18. The method of machining a rare earth alloy of claim 14, wherein the coolant includes a rust inhibitor.

19. The method of machining a rare earth alloy of claim 14, wherein the grinding edge of the grinding wheel further includes a phenol resin and includes the diamond abrasive particles in a volume ratio of 10 through 80%.

20. The method of machining a rare earth alloy of claim 14, wherein the grinding wheel has a disk-shaped base plate, the grinding edge is disposed on a peripheral portion of the base plate, and the base plate is made from a sintered hard alloy.

21. The method of machining a rare earth alloy of claim 14, wherein the rare earth alloy is a R—Fe—B rare earth sintered alloy.

22. The method of machining a rare earth alloy of claim 4, wherein the coolant is jetted toward the grinding edge.

23. The method of machining a rare earth alloy of claim 14, further comprising the steps of:

collecting sludge including grinding waste of the rare earth alloy and the coolant produced in the step of grinding the block; and separating the grinding waste of the rare earth alloy from the collected sludge by using a magnet.

24. The method of machining a rare earth alloy of claim 14, wherein the step of grinding the block includes a step of moving the grinding wheel relatively to the block, whereby the block is cut into pieces.

25. The method of machining a rare earth alloy of claim 14, wherein, in the step of grinding the block, a rotating speed of the grinding wheel, a cutting speed and a pressure for jetting the coolant are adjusted, whereby a force Fx along a tangent of the grinding wheel and a force Fz along a radial direction of the grinding wheel applied to the block respectively fall within predetermined ranges.

26. The method of machining a rare earth alloy of claim 25, further comprising the steps of:

monitoring the force Fx and the force Fz; and determining whether or not the force Fx and the force Fz respectively are within the predetermined ranges.

27. A method of fabricating a rare earth magnet comprising the steps of:

providing a block of the rare earth alloy;

rotatably supporting a grinding wheel having, on a peripheral portion thereof, a grinding edge including diamond abrasive particles;

grinding the block of the rare earth alloy by bringing the grinding edge into contact with the block, with the grinding wheel rotated, with a coolant having surface tension of 25 mN/m through 60 mN/m supplied to the grinding edge of the grinding wheel, and with the grinding wheel moved relatively to the block, whereby the block is cut into pieces; and magnetizing the rare earth alloy.

28. A method of machining a rare earth alloy comprising the steps of:

providing a block of the rare earth alloy;

establishing a cutting motion with a grinding part including diamond abrasive particles on its periphery facing the block, cutting the block of the rare earth alloy by bringing the grinding part into contact with the block, with the grinding part being moved and with a coolant having surface tension of 25 mN/m through through 60 mN/m supplied to the grinding part.

29. A method of machining a rare earth alloy comprising the steps of:

providing a block of the rare earth alloy;

establishing a cutting motion with a grinding part including diamond abrasive particles on its periphery facing the block, cutting the block of the rare earth alloy by bringing the grinding part into contact with the block, with the grinding part being moved and with a coolant having a coefficient of dynamic friction against the rare earth alloy of 0.1 through 0.3 supplied to the grinding part.

30. The method of machining a rare earth alloy of claim 28, wherein the coolant includes an antifoaming agent.

31. method of machining a rare earth alloy of claim 28, wherein the coolant has a pH of 9 through 11.

32. The method of machining a rare earth alloy of claim 28, wherein the coolant includes a rust inhibitor.

33. The method of machining a rare earth alloy of claim 28, wherein the grinding part further includes a phenol resin and includes the diamond abrasive particles in a volume ratio of 10 through 80%.

34. The method of machining a rare earth alloy of claim 28, wherein the rare earth alloy is a R—Fe—B rare earth sintered alloy.

35. A method of machining a rare earth alloy comprising the steps of:

providing a block of the rare earth alloy;

establishing a cutting motion with a grinding part including diamond abrasive particles on its periphery facing the block, cutting the block of the rare earth alloy by bringing the grinding part into contact with the block, with the grinding part being moved and with a coolant having a coefficient of dynamic friction against the rare earth alloy of 0.1 through 0.3 supplied to the grinding part.

36. The method of machining a rare earth alloy of claim 35, wherein the coolant includes water as a main component.

37. The method of machining a rare earth alloy of claim 35, wherein the coolant includes an antifoaming agent.

38. The method of machining a rare earth alloy of claim 35, wherein the coolant has a pH of 9 through 11.

39. The method of machining a rare earth alloy of claim 35, wherein the coolant includes a rust inhibitor.

40. The method of machining a rare earth alloy of claim 35, wherein the grinding part further includes a phenol resin and includes the diamond abrasive particles in a volume ratio of 10 through 80%.

41. The method of machining a rare earth alloy of claim 35, wherein the rare earth alloy is a R—Fe—B rare earth sintered alloy.

42. A method of fabricating a rare earth magnet comprising the steps of:

providing a block of the rare earth alloy;

establishing a cutting motion with a grinding part including diamond abrasive particles on its periphery facing the block, cutting the block of the rare earth alloy by bringing the grinding part into contact with the block, with the grinding part being moved, with a coolant having surface tension of 25 mN/m through 60 mN/m supplied to the grinding part, and with the grinding part moved relatively to the block, whereby the block is cut into pieces; and magnetizing the rare earth alloy.

* * * * *

UNITED STATES PATENT AND TRADEMARK OFFICE

CERTIFICATE OF CORRECTION

PATENT NO. : 6,471,583 B1
DATED : October 29, 2002
INVENTOR(S) : Sadahiko Kondo

It is certified that error appears in the above-identified patent and that said Letters Patent is hereby corrected as shown below:

Column 14,
Line 20, change "4," to -- 14, --

Signed and Sealed this

Seventh Day of October, 2003

JAMES E. ROGAN
*Director of the United States Patent and Trademark Office*